US010760370B2

(12) United States Patent
Jones

(10) Patent No.: US 10,760,370 B2
(45) Date of Patent: Sep. 1, 2020

(54) MICRO FRAC PLUG

(71) Applicant: MicroPlug, LLC, Clinton, OK (US)

(72) Inventor: Kevin Dewayne Jones, Clinton, OK (US)

(73) Assignee: MicroPlug, LLC, Clinton, OK (US)

( * ) Notice: Subject to any disclaimer, the term of this patent is extended or adjusted under 35 U.S.C. 154(b) by 274 days.

(21) Appl. No.: 15/844,768

(22) Filed: Dec. 18, 2017

(65) Prior Publication Data

US 2018/0171745 A1 Jun. 21, 2018

Related U.S. Application Data

(60) Provisional application No. 62/563,295, filed on Sep. 26, 2017, provisional application No. 62/504,262, filed on May 10, 2017, provisional application No. 62/466,461, filed on Mar. 3, 2017, provisional application No. 62/435,241, filed on Dec. 16, 2016.

(51) Int. Cl.

| | |
|---|---|
| ***E21B 33/12*** | (2006.01) |
| ***E21B 43/26*** | (2006.01) |
| ***E21B 33/13*** | (2006.01) |

(52) U.S. Cl.

CPC ..... *E21B 33/1208* (2013.01); *E21B 33/13* (2013.01); *E21B 43/26* (2013.01)

(58) Field of Classification Search

CPC ..... E21B 33/128; E21B 33/13; E21B 33/138

See application file for complete search history.

(56) References Cited

U.S. PATENT DOCUMENTS

| | | | | |
|---|---|---|---|---|
| 2,449,514 | A * | 9/1948 | Scoville, Jr. | E21B 33/128 277/341 |
| 2,754,910 | A | 7/1956 | Derrick et al. | |
| 3,292,700 | A | 12/1966 | Berry | |
| 3,376,934 | A * | 4/1968 | Willman | E21B 33/138 166/193 |
| 3,419,089 | A | 12/1968 | Venghiattis | |
| 3,595,314 | A | 7/1971 | Garner | |
| 3,858,571 | A * | 1/1975 | Rudolph | A61F 6/225 128/831 |
| 4,029,148 | A * | 6/1977 | Emery | C09K 8/80 166/250.1 |
| 4,139,060 | A | 2/1979 | Muecke et al. | |
| 4,187,909 | A | 2/1980 | Erbstoesser | |
| 4,194,561 | A | 3/1980 | Stokley et al. | |
| 4,287,952 | A | 9/1981 | Erbstoesser | |
| 4,407,368 | A | 10/1983 | Erbstoesser | |
| 5,253,709 | A | 10/1993 | Kendrick et al. | |
| 5,483,976 | A * | 1/1996 | McLaughlin | A61F 2/0009 128/885 |
| 5,782,745 | A * | 7/1998 | Benderev | A61F 2/0009 128/DIG. 25 |
| 5,990,051 | A | 11/1999 | Ischy et al. | |
| 8,505,632 | B2 | 8/2013 | Guerrero et al. | |

(Continued)

*Primary Examiner* — Robert E Fuller

(74) *Attorney, Agent, or Firm* — Tomlinson McKinstry, P.C.

(57) ABSTRACT

A micro frac plug used to seal individual perforations formed in a casing installed within a subterranean wellbore. The plug comprises an insert element and a deformable sleeve. The insert element is received and retained within a medial section of the sleeve. The plug is sized to be lodged in or seated on a single perforation. The plug blocks fluid from flowing through the perforation.

21 Claims, 8 Drawing Sheets

(56) References Cited

U.S. PATENT DOCUMENTS

| | | | | |
|---|---|---|---|---|
| 8,561,696 | B2 | 10/2013 | Trummer et al. | |
| 8,567,494 | B2 | 10/2013 | Rytlewski et al. | |
| 8,714,250 | B2 | 5/2014 | Baser et al. | |
| 8,851,172 | B1 | 10/2014 | Dudzinski | |
| 8,936,085 | B2 | 1/2015 | Boney et al. | |
| 8,950,438 | B2 | 2/2015 | Ryan | |
| 9,580,642 | B2 | 2/2017 | Brannon et al. | |
| 9,617,841 | B2 | 4/2017 | Boedeker et al. | |
| 9,745,820 | B2 | 8/2017 | Watson et al. | |
| 2004/0104025 | A1* | 6/2004 | Mikolajczyk | E21B 33/08 166/153 |
| 2007/0169935 | A1 | 7/2007 | Akbar et al. | |
| 2009/0101334 | A1 | 4/2009 | Baser et al. | |
| 2010/0200235 | A1 | 8/2010 | Luo et al. | |
| 2011/0036597 | A1* | 2/2011 | Corre | E21B 33/1277 166/387 |
| 2011/0221137 | A1 | 9/2011 | Obi et al. | |
| 2011/0226479 | A1 | 9/2011 | Tippel et al. | |
| 2017/0198179 | A1 | 7/2017 | Greenbauer et al. | |

* cited by examiner

MICRO FRAC PLUG

SUMMARY

The present invention is directed to a plug. The plug comprises an insert element and a deformable sleeve that receives and retains the insert element within a medial section.

The present invention is also directed to a method of assembling a plug. The method comprises the step of positioning an insert element within a deformable sleeve such that the sleeve receives and retains the insert element within a medial section.

DETAILED DESCRIPTION

Hydraulic Fracturing

Figure 1:
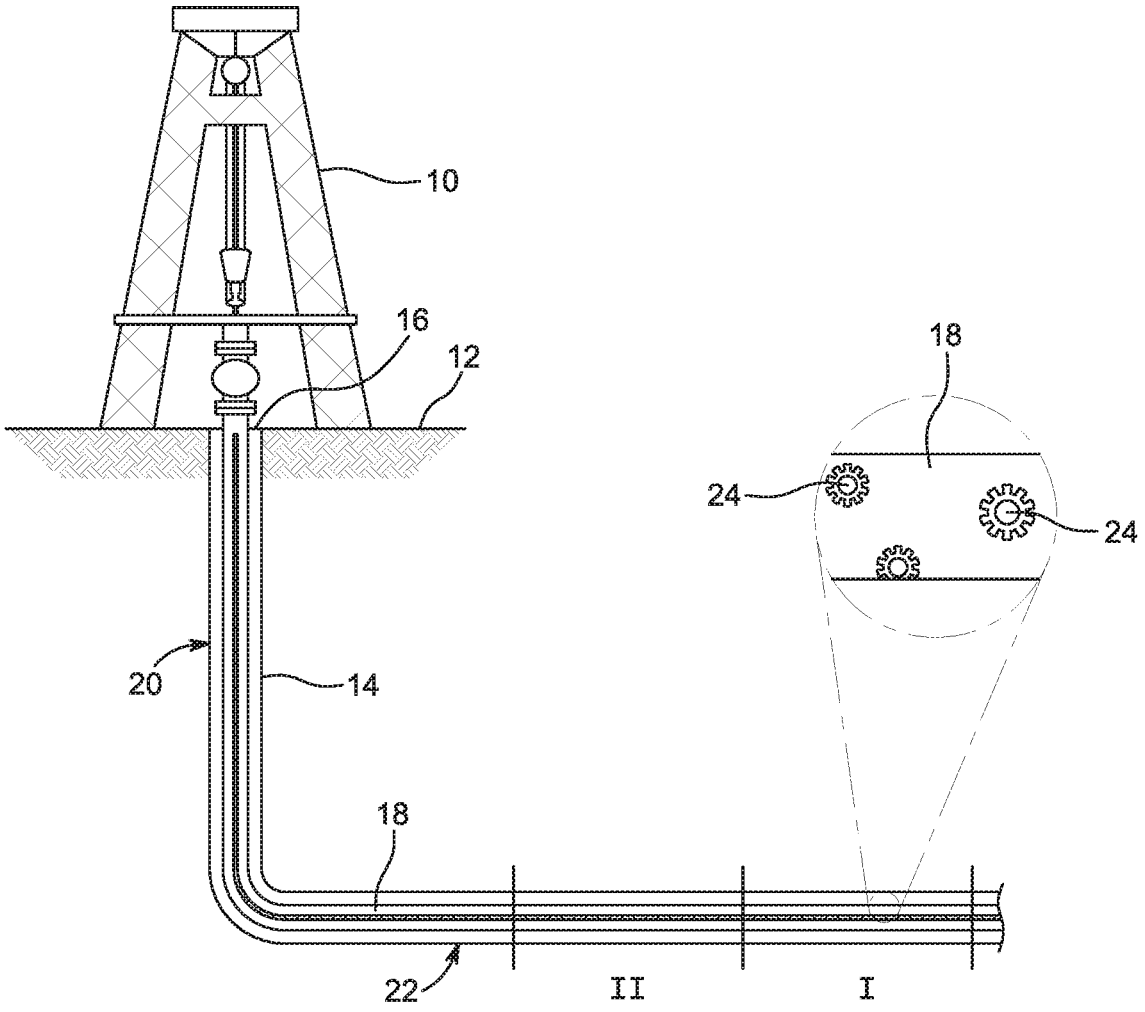
FIG. 1 is a schematic view of a drilling system. A casing is shown installed within a wellbore underground. An enlarged view of perforations formed in the casing is also shown.

With reference to FIG. 1, surface equipment 10 used in hydraulic fracturing operations is shown at a ground surface 12. A wellbore 14 is formed underground that has an opening 16 at the surface 12. A casing 18 is shown installed within the wellbore 14. The wellbore 14 has a vertical section 20 and a horizontal or lateral section 22. Oil or natural gas may be trapped inside subterranean rock formations surrounding the lateral section 22. Hydraulic fracturing operations are used to create fractures in the rock formations to allow the oil or natural gas to flow freely into the casing 18. Once in the casing 18, the oil or natural gas may be pumped through the casing to the surface 12.

The formation surrounding the lateral section 22 of the wellbore 14 is fractured using pressurized fluid pumped down the casing 18. The pressured fluid enters the surrounding formation through a plurality of perforations 24 punched in the walls of the casing 18 prior to fracturing, the formation. The fracturing operations may be performed in stages or zones along the lateral section 22 of the wellbore 14. Each stage is typically about 50 feet long. Thus, long distance lateral sections may have hundreds of stages on which to perform fracturing operations.

A first stage, shown for example by reference numeral I in FIG. 1, is normally the area most distant from the opening 16 of the wellbore 14. After Stage I is perforated and pressurized fluid has fractured the surrounding formation, an operator will move to Stage II. Stage II is shown for example in FIG. 1 as reference numeral II. Stage I is isolated from Stage II prior to sending pressured fluid into Stage II. If not, the pressurized fluid will flow into the perforations 24 formed in Stage I, rather than the perforations formed in Stage II.

Figure 2:
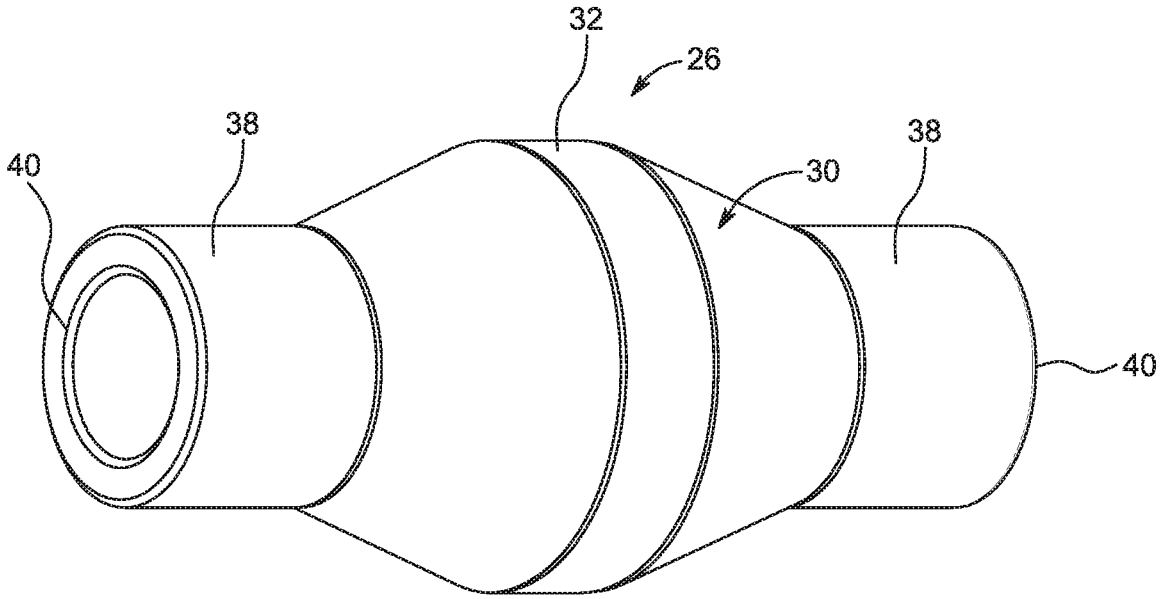
FIG. 2 is a perspective view of one embodiment of a micro frac plug of the present invention.
Figure 3:
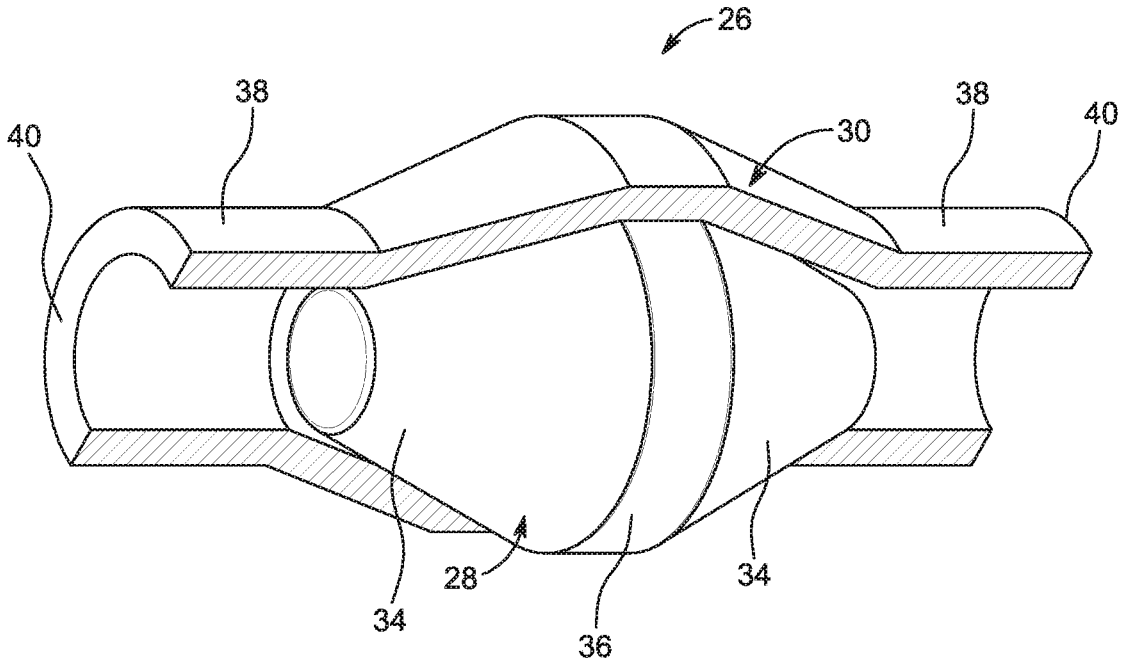
FIG. 3 is the plug of FIG. 2. A portion of a sleeve of the plug has been cut away for better display.

Turning now to FIGS. 2-3, one embodiment of a micro frac plug 26 is shown. The plug 26 comprises an insert element 28 (FIG. 3) and a deformable sleeve 30. The insert element 28 is received and retained within a medial section 32 of the sleeve 30. The plug 26 is preferably less than two inches in length and less than one inch in width. As described later herein, the plug 26 is sized to seal a single perforation 24 formed in the easing 18 (FIG. 1).

The maximum cross-sectional dimension of the insert element 28 exceeds the maximum cross-sectional dimension of the sleeve 30 when the sleeve is in a relaxed state. Thus, when the insert element 28 is inserted into the medial section 32 of the sleeve 30, the medial section 32 follows the contours of the insert element 28 or bulges is outward in conformity with the shape of the insert element 28. As shown inn FIG. 3, the insert element 28 has substantially identical cones or tapered ends 34 that join a cylindrical band 36 at their base. The degree of taper of the ends 34 may be varied as desired. The cylindrical band 36 has the external shape of a cylinder and may have less surface area than each of the tapered ends 34. Alternatively, the cylindrical band 36 may be removed and the tapered ends 34 may directly join each other at their base.

The sleeve 30 has sections 38 joined to opposite sides of its medial section 32. Each section 38 has an open end 40. The maximum cross-sectional dimension of the medial section 32 exceeds the maximum cross-sectional dimension of the sections 38 when the insert element 28 is retained inn the medial section 32.

Figure 4:
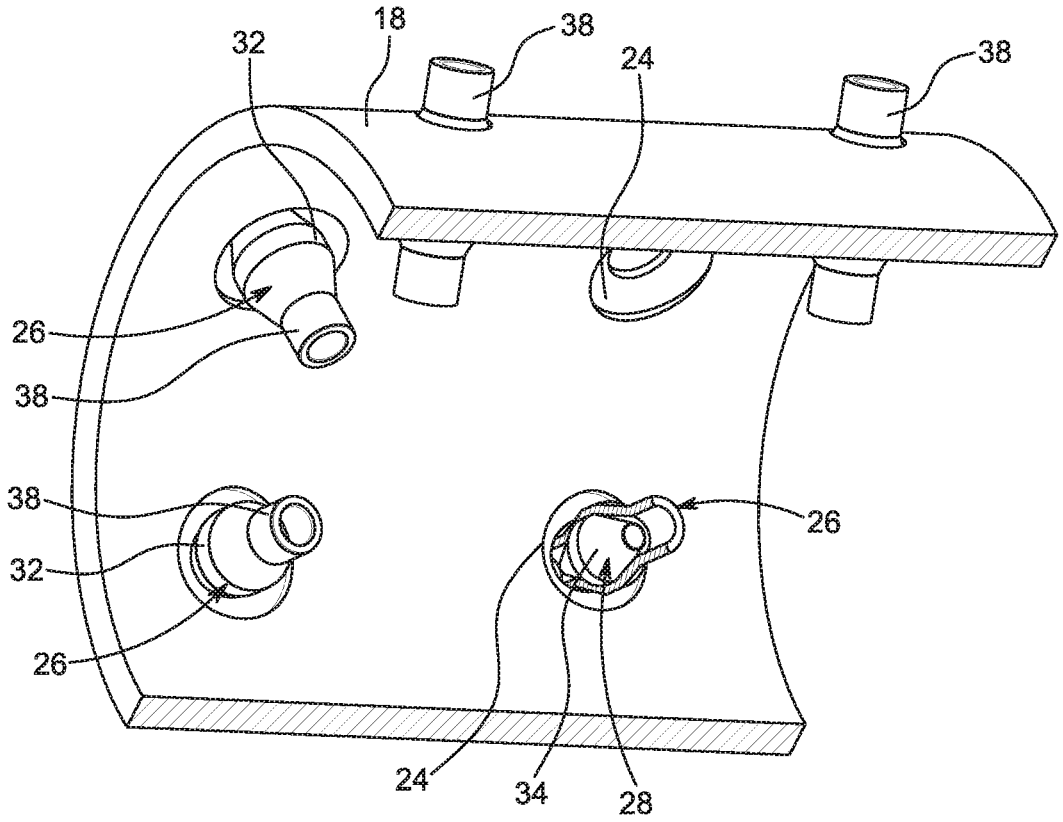
FIG. 4 is a perspective view of a section of a casing showing a plurality of the plugs of FIG. 2 lodged within perforations formed in the casing. A portion of the casing has been cut away for better display. A portion of a sleeve of one of the plugs has also been cut away for better display.

With reference to FIG. 4, the plug 26 may seal a perforation 24 by lodging one of its sections 38 into the perforation. The plug 26 is prevented from passing through the perforation 24 by the bulging medial section 32. The operator may regulate the amount of pressure required to remove the plug 26 from the perforation 24 by selecting a plug 26 having ends 34 of varying taper. When a plug 26 uses an insert element 28 having a larger taper angle at its ends 34, insertion through a perforation 24 becomes more difficult. A broadly tapered end 34 enlarges the sleeve 30. This enlargement may fully or partially block passage of the end section 38 through the perforation 24. The pressure required to remove a plug 26 from a perforation increases with its degree of penetration.

Figure 5:
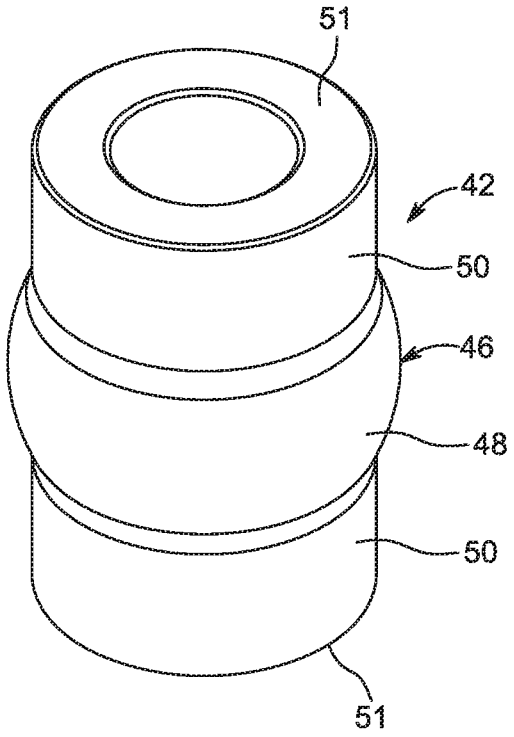
FIG. 5 is a perspective view of an alternative embodiment of the plug.
Figure 6:
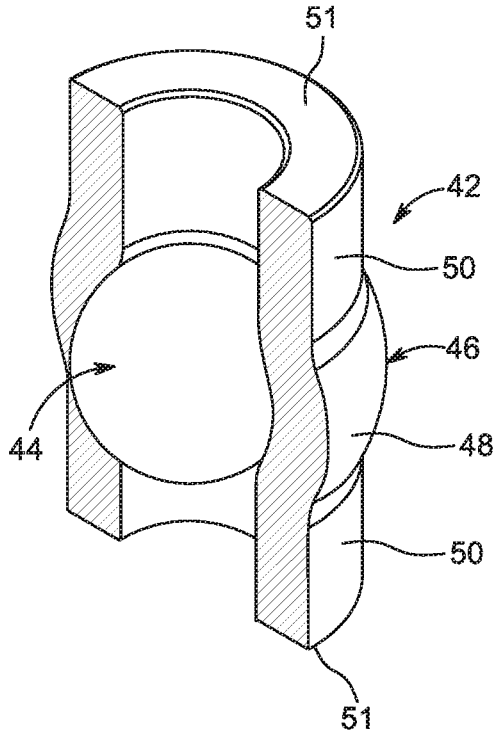
FIG. 6 is the plug of FIG. 5. A portion of the sleeve of the plug has been cut away for better display.

Turning now to FIGS. 5-6, an alternative embodiment of the micro frac plug 42 is shown. The plug 42 comprises an insert element 44 (FIG. 6) and a deformable sleeve 46. Like plug 26, the insert element 44 is received and retained within a medial section 48 of the sleeve 46. The sleeve 46 has sections 50 joined to opposite sides of the medial section 48. Each section 50 has an open end 51. The insert element 44 in plug 42 has the shape of a sphere. The sections 50 may have a larger maximum cross-sectional dimension than the sections 38 of the plug 26 (FIGS. 2-3). Like plug 26, the plug 42 is sized to seal a single perforation 24 formed in the casing 18 (FIG. 1).

Figure 7:
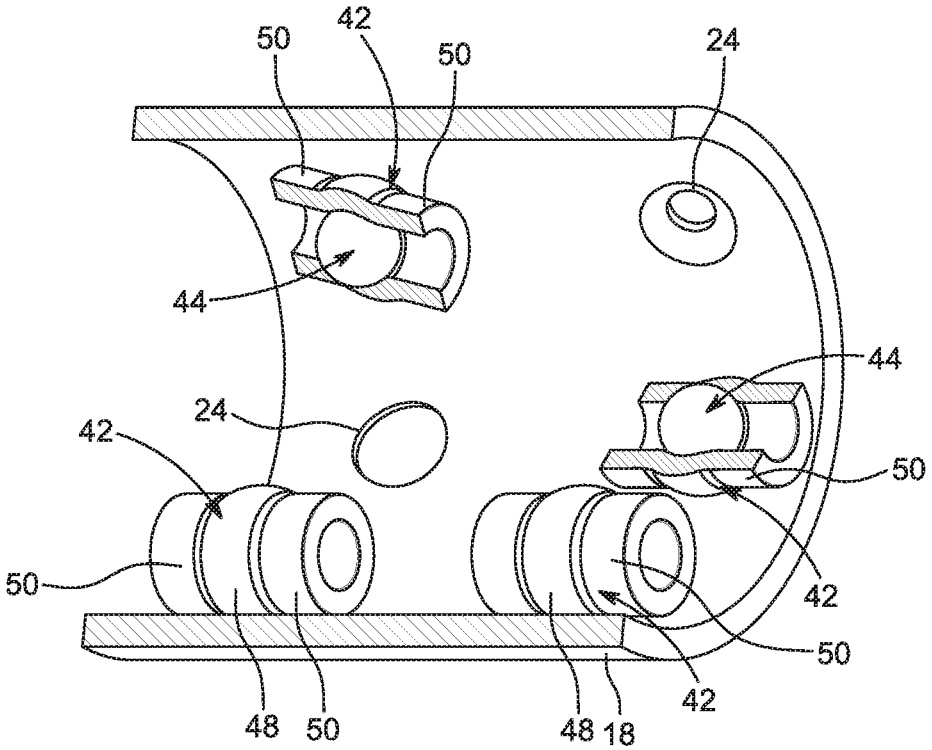
FIG. 7 is a perspective view of a section of a casing showing a plurality of the plugs of FIG. 5 seated on perforations formed in the casing. A portion of the casing has been cut away for better display. A portion of a sleeve of two of the plugs has been cut away for better display.

With reference to FIG. 7, the plug 42 seals perforations 24 by seating the bulging medial section 48 on the perforation 24. Because the sections 50 of the plugs 42 may not fit into the perforation 24, a reduction of pressure in the casing 18 can unseat all of the plugs 42 simultaneously.

Figure 8:
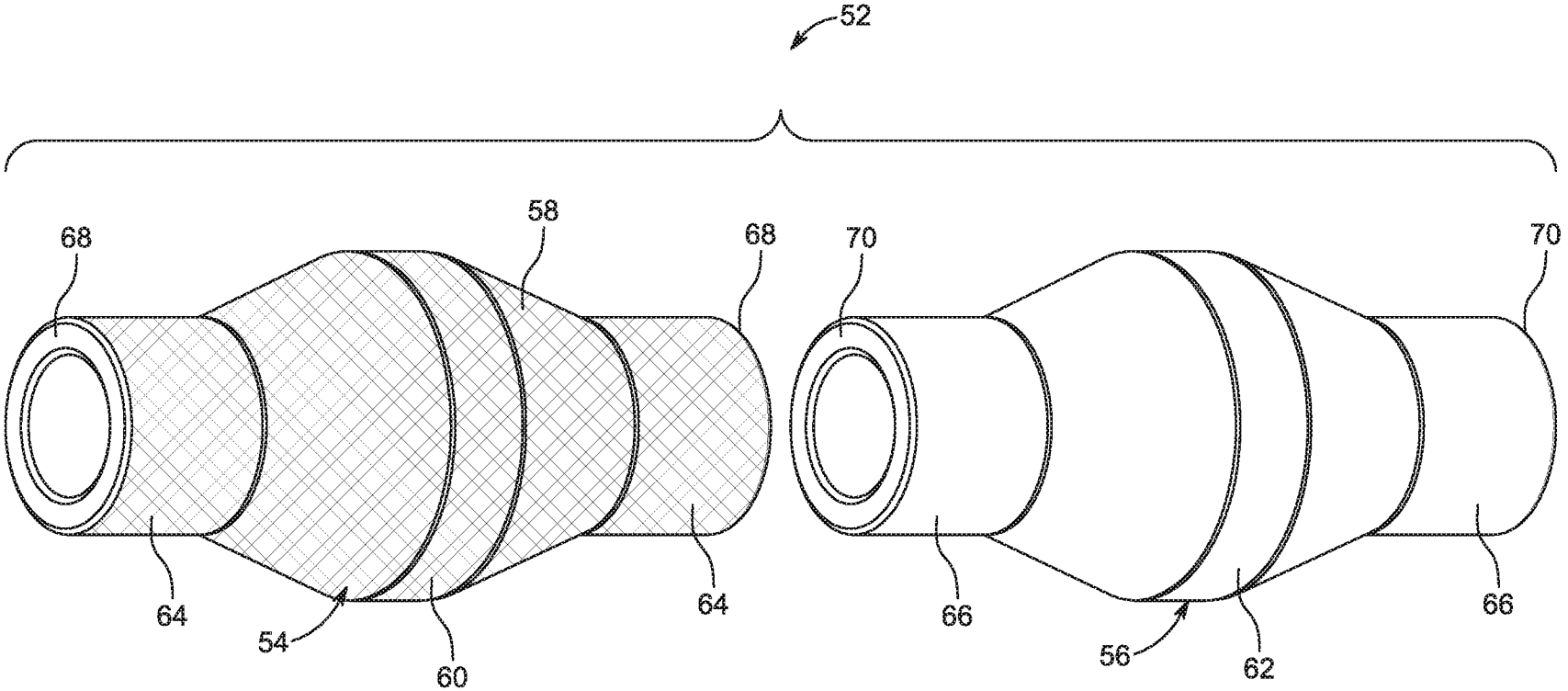
FIG. 8 is an exploded view of another alternative embodiment of the plug.

Turning now to FIG. 8, another alternative embodiment of the micro frac plug 52 is shown. The plug 52 comprises an insert element (not shown), a deformable inner sleeve 54 and a deformable outer sleeve 56. A series of helical ridges 58 may be formed on an outer surface of the inner sleeve 54. Each ridge 58 may be formed by spiral winding of string that forms a tube-shaped structure around the inner sleeve 54. The string may be made of nylon, Kevlar or other durable materials. The helical ridges 58 make the inner sleeve 54 less likely to tear during operation. The inner sleeve 54 may be installed within the outer sleeve 56. The outer sleeve 56 provides protection to the helical ridges 58.

Either of the previously described insert elements 28 and 44 may be used as the insert element for the plug 52. The plug 52 shown in FIG. 8 contains insert element 28. The sleeves 54, 56 may be formed identical to the previously described sleeves 30 or 46. If the plug 52 uses the insert element 28, then the sleeves 54, 56 will be formed identical to sleeve 30. If the plug 52 uses the insert element 44, then the sleeves 54, 56 will be formed identical to sleeve 46. The sleeves 54, 56 each have sections 64, 66 joined to opposite sides of the medial sections 60, 62. Each of the sections 64, 66 has open ends 68, 70. Using two sleeves 54, 56 and the helical ridges 58 makes the plug 52 more durable. Like plugs 26 and 42, the plug 52 is sized to seal a single perforation 24 formed in the casing 18 (FIG. 1). The plug 52 may function as shown in FIG. 4 or 7, depending on the shape of insert element 28 or 44 that is used with the plug 52.

The insert elements 28, 44 are preferably made of plastic, such as a thermoplastic or thermoset. However, the insert elements 28 or 44 may be made of any material capable of withstanding high pressure. For example, the insert elements 28, 44 may be made of the same material as the sleeves 30, 46, 54, or 56. In some embodiments, the insert element 28 or 44 may be firmer than the sleeves 30, 46, 54, or 56. The insert elements 28 or 44 may have different shapes than those disclosed herein, such as shapes having oval or hexagonal profiles. However, the insert element must be shaped such that it can seal a single perforation 24 when installed within the sleeves 30, 46, 54, or 56. The insert elements 28 or 44 may be solid or hollow.

The sleeves 30, 46, 54, or 56 are preferably made of an elastic material, such as silicon, rubber, or neoprene. However, the sleeves 30, 46, 54, or 56 may be made out of any material that has elastic and viscous qualities such that it can block fluid from passing through a perforation 24. The plugs 26, 42, or 52 may vary in size in accordance with the size of the perforations formed in the casing 18.

With references to FIGS. 1, 4 and 7, after fracturing operations have been performed on Stage I, the plugs 26, 42, or 52 may be pumped down the casing 18 in fluid to seal Stage I. The plugs 26, 42, or 52 are free to move throughout the fluid as they are pumped down the casing 18. Alternatively, the plugs 26, 42, or 52 may be lowered down the casing 18 in a downhole tool attached to a wireline (not shown). Once the plugs 26, 42, or 52 reach Stage I, the downhole tool may release the plugs in response to a command from the operator at the surface 12.

Fluid within Stage I will flow towards the perforations 24 and the plugs 26, 42, 52 will follow. The medial sections 32, 48, 60, or 62 of the plugs 26, 42, or 52 are designed to be larger than the perforations 24. Thus, the plugs 26, 42, or 52 are unable to pass through the perforations 24 with the fluid. Instead, each plug 26, 42, or 52 will become lodged within or seated on a perforation 24 and block the flow of fluid through the perforation. The plugs 26, 42, or 52 are held over or within the perforations 24 by fluid pressure. The plugs 26, 42, or 52 are removed from the perforations 24 by decreasing the fluid pressure within the casing 18.

The perforations 24 typically have a circular shape. If a perforation 24 has a circular shape, a plug 42 may fill or cover the entire perforation 24. Alternatively, the perforations 24 may be tear-shaped or non-symmetrically shaped. In this case, the sections 38 of the sleeves 30 may fill those portions of the perforations 24 not filled or covered by the medial sections 23. Alternatively, more than one plug 26 may seat against the same perforation 24 to seal army open areas. This description applies to the plugs 42 and 52 as well.

The density of the plugs 26, 42, or 52 determines which perforation 24 within the casing 18 the plugs will seal. The density of the plugs 26, 42, or 52 is varied by varying the weight of the insert elements 28, 44 or the weight of the sleeves 30, 46, 54, or 56. For example, gravity will cause a heavier plug 26, 42, or 52 to sink toward the bottom of the casing 18, and seal perforations 24 nearby. In contrast, a lighter plug 26, 42 or 52 can float within fluid at the top of the casing 18, and seal nearby perforations.

The plugs 26, 42, or 52 are preferably weighted so that they flow through the casing 18 at the same rate as fluid being pumped through the casing 18. This preferred weight is to create maximum efficiency of fracturing operations when using the plugs 26, 42, or 52. For example, each wellbore 14 may have a different rate at which fluid flows through the casing 18, depending on the depth of the vertical section 20 or length of the lateral section 22.

In operation, the plugs 26, 42, or 52 may be used to isolate different areas or zones of each stage while fracturing the formation surrounding each stage. For example, the casing 18 within Stage I may have forty perforations 24. The operator may decide to first pump fifteen plugs 26, 42, or 52 into Stage I. The plugs 26, 42, or 52 may seal the first fifteen perforations 24. High pressure fluid may then be pumped down the casing 18, and flow through the remaining twenty-five open perforations 24 to fracture the surrounding formation. The operator, for example, may next pump two plugs 26, 42, or 52 into Stage I and later pump seven plugs 26, 42, or 52 into Stage I. This process may be repeated as many times as needed to isolate different areas or zones within Stage I prior to moving to Stage II.

Once fracturing operations are completed in Stage I, the operator may be ready to move to Stage II. To start, Stage II may be perforated using a series of perforation guns (not shown) known in the art. The guns operate by firing explosive charges through the walls of the casing 18. The perforation guns may be lowered to Stage II within a downhole tool attached to a wireline (not shown). Some of the perforations within Stage I may be left open prior to lowering, the downhole tool into Stage II. If all of the perforations 24 within Stage I are sealed prior to lowering the downhole tool, the pressure within the casing 18 may make it difficult for the tool to reach Stage II. Leaving some perforations 24 open decreases the pressure within the casing 18, making it easier to lower the tool into Stage II.

If some of the perforations 24 are left open, the number of plugs 26, 42, or 52 required to seal the open perforations may be included in the downhole tool with the perforation guns. The plugs 26, 42, or 52 may be released from the tool in response to a command from an operator at the surface 12 once the tool reaches Stage II. The released plugs 26, 42, or 52 may seal the open perforations 24 within Stage I in order to completely seal all of Stage I.

The plugs 26, 42, or 52 may be lowered into the casing 18 in the downhole is tool rather than being pumped down the casing 18 in order to increase efficiency and to not waste fluid. However, the downhole tool and the plugs 26, 42, or 52 may be sent down the casing 18 independently, if desired. Stage I may also be completely sealed prior to lowering the perforation guns into Stage II, if possible.

After all of the perforations 24 are sealed in Stage I, Stage II may be perforated. Stage II is perforated after sealing Stage I so new plugs 26, 42, or 52 do not seal perforations in Stage II prior to sealing all of Stage I. Otherwise, areas in Stage II may not be fractured and areas of Stage I may be fractured a second time.

In order to perforate Stage II, the downhole tool may release the perforation guns in response to a command from the operator at the surface 12. The guns may each travel a designated distance so they are spaced throughout the casing 18 in Stage II. The guns may be set to fire a set time after they are released from the downhole tool. Once the new perforations 24 are made in Stage II, the downhole tool and perforating guns may be removed from the casing 18. After the perforation guns are removed from the casing 18, pressurized fluid may then be pumped down the casing 18 to perform fracturing operations in Stage II. Alternatively, new plugs 26, 42, or 52 may be pumped down the casing 18 to isolate different areas or zones in Stage II, prior to performing fracturing operations in Stage II.

The above described processes are repeated as many times as needed, depending on the amount of stages identified for fracturing throughout the wellbore 14. The stages progress up the wellbore 14 toward the opening 16, starting with the zone most distant from the opening 16. Using the plugs 26, 42, or 52 allows the operator to perforate a longer portion of the wellbore 14 at one time than is typically possible during standard fracturing operations. The plugs 26, 42, or 52 allow the operator to isolate different areas or zones within the same stage. In contrast, traditional large composite frac plugs known in the art must isolate an entire stage at one time.

Perforating longer distances at a time increases the length of each stage, reducing the number of stages within each lateral section 22 of the wellbore 14. Reducing the number of stages also reduces the number of times a wireline must be lowered down the casing 18 to perforate to each stage. Thus, using the plugs 26, 42, or 52 reduces the amount of time required to perform fracturing operations.

Once hydraulic fracturing operations are complete, the plugs 26, 42, or 52 may be removed from the casing 18. Fluid contained within the casing is typically pumped out of the casing 18 after operations are complete. In casings 18 containing high pressure gradients within the stages, the plugs 26, 42, or 52 will flow from the casing 18 with the fluid and be retrieved at surface 12. Retrieval at the surface 12 means there is no need for any drilling out of plugs 26, 42, or 52. Such drilling has been required to remove the large composite frac plugs known in the art.

The wellbore 14 or casing 18 may have zones or stages with different pressure gradients. If so, the plugs 26, 42, or 52 in the lower pressure zones will stay lodged in or seated on the perforations 24 until the pressure within the wellbore 14 has equalized with that in the formation. The plugs 26, 42, or 52 prevent loss of oil and natural gas recovered from high pressure zones. Without the plugs 26, 42, or 52, such oil and gas would flow back into the formation through open perforations in a lower pressure zone. Once pressure within the wellbore 14 is equalized, the plugs 26, 42, or 52 in the lower pressure zones will unseat from the perforations 24 and may be retrieved at surface 12 in fluid.

A plug removing tool (not shown) may be used to remove the plugs 26, 42, or 52 from the casing 18 if they cannot be retrieved at surface 12. The plug removing tool may feature edges that scrape the sides of the casing 18 and pick up any plugs 26, 42, or 52 lodged in or seated on the perforations 24. The removed plugs 26, 42, or 52 may be received within the tool after they are removed from the perforations 24. The tool is then removed from the casing 18.

The sleeves 30, 46, 54, or 56 of the plugs 26, 42, or 52 may vary in color or pattern. This variance allows different colored or patterned sleeves 30, 46, 54, or 56 to be used in different stages or zones of the wellbore 14 during fracturing operations. When the plugs 26, 42, or 52 are removed from the wellbore 14, the operator can determine which perforations 24 are open based on the color or pattern of the sleeve 30, 46, 54, or 56. For example, all of the plugs 26, 42, or 52 used in Stage I may have blue sleeves 30, 46, 54, or 56 and all of the plugs 26, 42, or 52 used in Stage II may have red sleeves 30, 46, 54, or 56. With such color coding, there is no need for any of the more complex methods that determine which perforations are open. Pumping radioactive trace materials is one such prior art method.

The insert elements 28 or 44 used with the plugs 26, 42, or 52 may also be made of a soluble material, such as starch, potassium, or folic acid based materials. Using a soluble material allows the insert elements 28 or 44 to dissolve over time. Once dissolved, the plugs 26, 42, or 52 may easily be removed from the casing 18 with fluid.

Pipe Recovery

Figure 9:
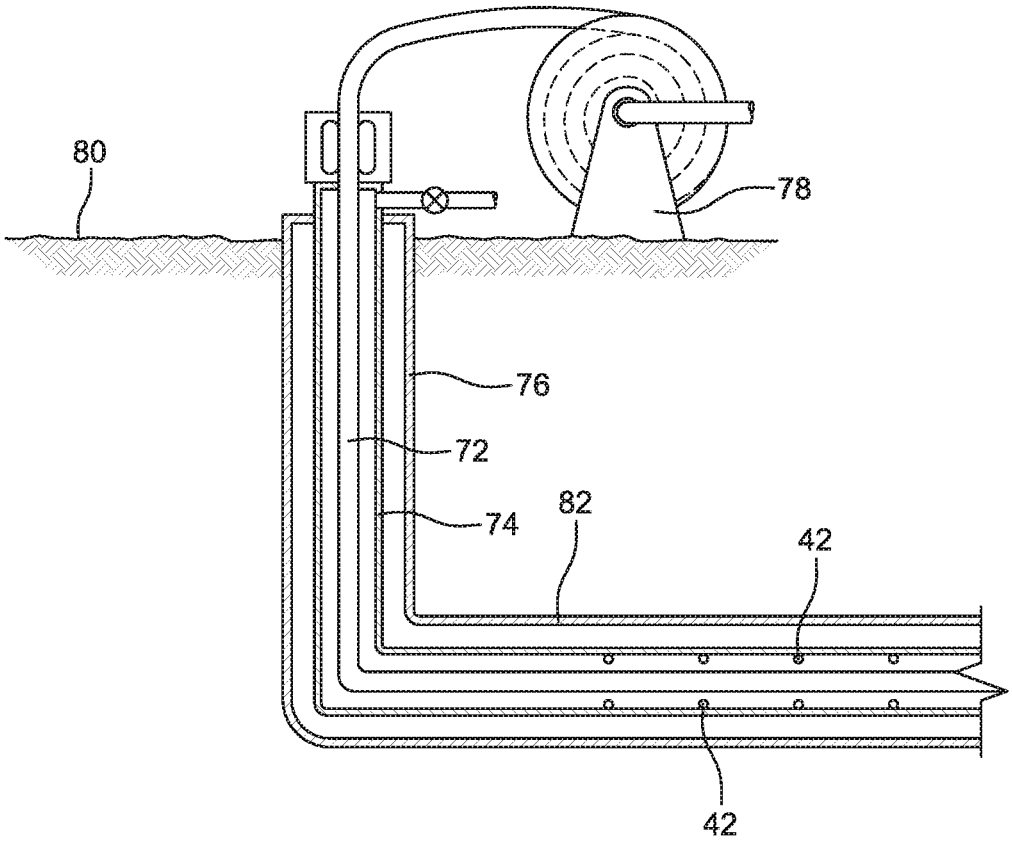
FIG. 9 is a schematic view of a coiled tubing drilling system. The coiled tubing is positioned within the casing in the wellbore. A plurality of plugs are shown seated on the perforations formed within the casing.

With reference to FIG. 9, the plugs 26, 42, or 52 may also be used during the pipe recovery process of oil and gas operations. During such operations, a tubular work string 72 may be sent down a casing 74 installed within a wellbore 76 to deliver tools or to mill up debris within the casing 74. For example, if large composite plugs have been used during a frac operation, those plugs will need to be milled into pieces to be removed from the casing 74. Work strings 72 are typically made up of jointed pipe or coiled tubing. FIG. 9 shows a coiled tubing work string 72. The coiled tubing work string 72 is supported on a reel 78 at surface 80.

During operation, the work string 72 may become stuck in a lateral section 82 of the wellbore 76 due to plug debris, well debris, formation material or completion material within the casing 74. In order to help free the stuck work string 72, hydraulic energy or fluid is often used to wash away debris. Such fluid is pumped into the annulus between the casing 74 and the work string 72. But when the casing 74 carries perforations from the completion process, fluid may flow through those perforations, instead of flowing toward the stuck point. To prevent such diversion, the plugs 26, 42, or 52 may be used to fill the perforations.

By way of example, the plugs 42 are shown seated on the perforations in FIG. 9. The plugs 42 help direct fluid towards the stuck point, where it can wash away debris. In operation, ten plugs 42, for example, may be pumped down the casing 74 to fill the first ten perforations. Fluid may then be pumped down the casing 74 to flush any debris around the ten plugs 42 further down the casing. Another ten plugs 42 may then be pumped down the casing 74 to fill the next ten perforations. Fluid may again be pumped down the casing 74 to flush any debris around the second set of ten perforations further down the casing 74. This process is repeated as needed until debris is flushed far enough out of the way so as to help release the work string 72 from its stuck point.

The plugs 42 may remain seated within the perforations while the work string 72 is being removed from the casing 74. The seated plugs 42 serve as bearings that engage the work string 72 and ease its removal from the casing 74.

The above described process of sending plugs 42 down the casing 74 in intervals may also be used to clean any sand or formation material from the inside of the casing 74. Fluid pumped down an empty casing 74 may flush any sand or loose formation material through the perforations and into the formation surrounding the wellbore 76. The plugs 42 are pumped down in intervals to allow the fluid to flow farther and farther down the casing 74 so as to continually flush the material through the perforations.

Changes may be made in the construction, operation and arrangement of the various parts, elements, steps and procedures described herein without departing from the spirit and scope of the invention as described in the following claims.

The invention claimed is:

1. A plug, comprising:

an insert element comprising the shape of two cones; and a deformable sleeve that receives and retains the insert element within a medial section, in which the sleeve is tubular and is open on its opposed first and second ends, and in which the plug is less than two inches in length.

2. The plug of claim 1 in which the medial section follows the contours of the insert element when the insert element is retained within the sleeve.

3. The plug of claim 1 in which the insert element is firmer than the sleeve.

4. The plug of claim 1 in which the two cones are joined at their base by a cylindrical band.

5. The plug of claim 1 in which the sleeve is rubber.

6. The plug of claim 1 in which the sleeve comprises an inner sleeve and a separate outer sleeve positioned over the inner sleeve.

7. The plug of claim 6 in which an outer surface of the inner sleeve carries a helical ridge.

8. The plug of claim 7 in which the helical ridge is formed by string wound around the inner sleeve.

9. The plug of claim 1 in which the plug is less than one inch in width.

10. The plug of claim 1 in which the insert element is made of a soluble material.

11. A system, comprising:

a first set of a plurality of the plugs of claim 1, in which each of the plugs in the first set is the same color; and a second set of a plurality of the plugs of claim 1, in which each of the plugs in the second set is the same color, such color being a different color from that of the first set.

12. The plug of claim 1 in which the insert element is a single piece.

13. The plug of claim 1 in which the opposed first and second ends have the same shape.

14. The plug of claim 1 in which the opposed first and second ends are the same size.

15. A system, comprising:

a subterranean wellbore having a perforated casing; and a plurality of plugs situated within the wellbore, each plug comprising:

an insert element comprising the shape of two cones; and a deformable sleeve that receives and retains the insert element within a medial section, in which the plug is less than two inches in length.

16. A method for treating a wellbore having a perforated casing comprising:

lowering a plurality of plugs into the casing, each plug comprising:

an insert element comprising the shape of two cones; and a deformable sleeve that receives and retains the insert element within a medial section, in which the plug is less than two inches in length.

17. The method of claim 16 in which the plurality of plugs are lowered into the casing within fluid.

18. The method of claim 16 in which the plurality of plugs are lowered into the casing in a downhole tool.

19. The method of claim 16 further comprising removing at least one plug from the casing by pumping the plug out of the casing along with fluid contained within the casing.

20. A plug, comprising:

an insert element comprising the shape of two cones; and a deformable sleeve that receives and retains the insert element within a medial section, in which the sleeve comprises an inner sleeve and a separate outer sleeve positioned over the inner sleeve, in which an outer surface of the inner sleeve carries a helical ridge, and in which the plug is less than two inches in length.

21. The plug of claim 20 in which the helical ridge is formed by a string wound around the inner sleeve.

* * * * *